US007794062B2

(12) United States Patent
Ito

(10) Patent No.: US 7,794,062 B2
(45) Date of Patent: Sep. 14, 2010

(54) LIQUID DROPLET EJECTING DEVICE

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 610 days.

(21) Appl. No.: 11/894,245

(22) Filed: Aug. 20, 2007

(65) Prior Publication Data

US 2008/0049075 A1 Feb. 28, 2008

(30) Foreign Application Priority Data

Aug. 24, 2006 (JP) ..... 2006-227855

(51) Int. Cl.
*B41J 2/045* (2006.01)

(52) U.S. Cl. ..... 347/68; 347/40; 347/71

(58) Field of Classification Search ..... 347/20, 347/40, 54, 56, 63, 65, 67–68, 70–72
See application file for complete search history.

(56) References Cited

U.S. PATENT DOCUMENTS 5,748,214 A * 5/1998 Usui et al. ..... 347/70
6,648,452 B2 11/2003 Ito
2006/0132552 A1 6/2006 Ito

FOREIGN PATENT DOCUMENTS

JP 3674495 5/2005
JP 2006-175741 7/2006

* cited by examiner

*Primary Examiner*—Juanita D Stephens
(74) *Attorney, Agent, or Firm*—Frommer Lawrence & Haug LLP

(57) ABSTRACT

An ink-jet printer head comprises a plurality of pressure chambers, a plurality of restricting passages which are arranged in parallel and are respectively connected to the plurality of pressure chambers, and a dummy restricting passage provided to be located adjacent a restricting passage located at an end in a direction in which the restricting passages are arranged. The pressure chambers other than the pressure chamber located at an end in which the pressure chambers are arranged are respectively configured to at least partially overlap with passages connected to their adjacent pressure chambers as viewed from above, and the dummy connecting passage forms an inner space at least partially overlapping with the pressure chamber located at the end as viewed from above.

9 Claims, 7 Drawing Sheets

LIQUID DROPLET EJECTING DEVICE

Technical Field

The present invention relates to a liquid droplet ejecting device for ejecting liquid droplets to a medium such as papers through a plurality of channels, for example, an ink-jet printer head. More particularly, the present invention relates to a liquid droplet ejecting device which reduces a difference in stiffness between a plurality of channels to suppress non-uniformity of liquid droplet ejecting characteristic.

Background Art

Typically, an ink-jet printer head is configured to feed, through a plurality of channels, ink supplied from an ink tank to a common ink chamber and to eject the ink from nozzle holes respectively provided for the channels. More specifically, the ink-jet printer head has a passage unit including a plurality of stacked plates. The passage unit is provided inside thereof with channels including the common ink chamber, pressure chambers, connecting passages connecting the common ink chamber to the pressure chambers, discharge passages extending from the pressure chambers, and nozzle holes provided at downstream ends of the discharge passages (see Japanese Patent No. 3674496, and Japanese Laid-Open Patent Application Publication No. 2006-175741).

The ink is supplied from the common ink chamber to the pressure chambers through the connecting passages and is pressurized therein. Then, the ink is ejected to the outside from the nozzle holes through the discharge passages. At least a part (restricting portion) of the connecting passages connecting the common ink chamber to the pressure chambers have a passage cross-sectional area smaller than that of the pressure chambers to increase flow resistance of the ink, thereby suppressing back flow of the ink toward the common ink chamber when the ink is pressurized in the pressure chamber.

In the ink-jet printer head disclosed in Japanese Patent No. 3674496, elongate pressure chamber holes are formed on one pressure chamber plate so as to extend on a plate surface and passage-like restricting portions further extend from ends of these elongate pressure chamber holes. That is, the pressure chamber plate has a number of elongate passages which include the pressure chamber holes and the restricting portions extending from the pressure chamber holes in the longitudinal direction of the passage chamber holes and are arranged in parallel, thus forming passage rows. A plurality of passage rows are arranged in parallel on the pressure chamber plate.

In such a structure, since the restricting portions extend from the pressure chamber holes in the longitudinal direction of the pressure chamber holes, the passages are long when the pressure chamber plate is viewed from above. The restricting portions cannot be reduced to a specified length or less because of a need to provide a flow resistance. It is therefore difficult to reduce the whole length of both of the pressure chambers and the restricting portions. This may increase the width of the passage rows, reducing the number of the passage rows which can be arranged in parallel on one pressure chamber plate. Under the circumstances, it has been difficult to meet a need to provide increased channels, namely, high-density channels in recent ink-jet printer heads.

Meanwhile, the above described Publication No. 2006-175741 discloses a channel shape in which the pressure chambers and the restricting portions are formed on separate plates which are stacked so that the restricting portions are disposed under the pressure chambers. When this channel shape is viewed from the direction in which the plates are stacked, the dimension of the passages including the pressure chambers and the restricting portions is short and the width of the passage rows is small. In this channel shape, a number of passage rows can be arranged and as a result the number of channels can be increased.

If the length of the pressure chamber is reduced, then a natural frequency of the ink in the pressure chamber is reduced, enabling the ink to be ejected in short cycles. So, in order to realize higher-density channels and higher-speed printing, the inventors focused attention to reducing the length of the pressure chambers. By reducing the length of the pressure chambers, the width of the common ink chamber is reduced. But, as described above, the restricting portions are required to have a length sufficient to provide flow resistance. So, it is difficult to arrange the pressure chambers and the restricting portions in parallel so that the restricting portion lies within the area of the pressure chamber as viewed from above, as in the prior art example of the Publication No. 2006-175741. Accordingly, to realize high-density channels and high-speed printing, the inventors made an attempt to tilt the restricting portions with respect to the longitudinal direction of the pressure chambers so that the length of the pressure chambers is reduced without being limited by a required length of the restricting portions.

However, if the restricting portions are disposed to be tilted with respect to the longitudinal direction of the pressure chambers as described above, a difference in stiffness is generated between a channel located at an end and the other channels. More specifically, when viewed in the direction in which the plates are stacked, the pressure chambers other than the pressure chamber located at the end partially overlap with the restricting portions extending obliquely from their adjacent pressure chambers on one side.

On the other hand, since there is no adjacent pressure chamber or no restricting portion extending from the pressure chamber on one side of the pressure chamber located at the end. Therefore, a cross-section formed by sectioning the passage unit along the direction in which the plates are stacked through the pressure chamber located at the end is different in shape from a cross-section formed by sectioning the passage unit through the other pressure chambers. The difference in the shape of the cross-section causes a difference in stiffness between the cross-sections of the passage unit. If the stiffness is different in regions in the vicinity of the respective pressure chambers in the passage unit, then the pressure applied to the pressure chamber to eject the ink may be absorbed by deformation of the region with smaller stiffness and thereby a difference is substantially generated in the pressure to be applied to the ink. In addition, a difference is generated in natural frequency in the regions surrounding the pressure chambers. This negatively affects oscillation of the ink. As a result, non-uniform ink ejecting characteristic undesirably occurs in the channels respectively having the pressure chambers. Such a situation arises not only in the ink-jet printer head but also in general liquid droplet ejecting devices comprising the passage unit having similar channels.

SUMMARY OF THE INVENTION

Accordingly, an object of the present invention is to provide a liquid droplet ejecting device which is capable of suppressing difference in stiffness between channels to achieve uniform ink ejecting characteristic while providing high-density channels.

According to the present invention, there is provided a liquid droplet ejecting device comprising a plurality of pressure chambers arranged in parallel to feed ink inside thereof toward nozzles by pressure fluctuation; a plurality of connecting passages which are arranged in parallel and are respectively connected to the plurality of pressure chambers to guide ink from a common ink chamber to the plurality of pressure chambers; and a dummy connecting passage provided to be located adjacent a connecting passage located at an end in a direction in which the connecting passages are arranged; wherein pressure chambers other than a pressure chamber located at an end in which the pressure chambers are arranged are respectively configured to at least partially overlap with connecting passages connected to their adjacent pressure chambers as viewed from above; and wherein the dummy connecting passage forms an inner space at least partially overlapping with the pressure chamber located at the end as viewed from above.

In such a configuration, since the region in the vicinity of the pressure chamber located at the end in the direction in which the plurality of pressure chambers are arranged has substantially the same structure as the regions in the vicinity of the other pressure chambers, a difference in stiffness between them is reduced, and uniform liquid droplet ejecting characteristic is achieved in the channels. Such a uniform liquid droplet ejecting characteristic can be achieved while realizing high-density channels including the pressure chambers, the connecting passages, and the like.

The dummy connecting passage may be positioned to be spaced apart from the connecting passage located at the end with a distance substantially equal to a distance between the arranged connecting passages. In such a configuration, since the region in the vicinity of the channel located at the end has substantially the same structure as the regions in the vicinity of the other channels, the difference in stiffness between the regions in the vicinity of the channels can be further reduced.

The dummy connecting passage may include a plurality of dummy connecting passages arranged adjacent the connecting passage located at the end and along the direction in which the connecting passages are arranged. In such a configuration, the difference in stiffness between the region in the vicinity of the channel located at the end and the regions in the vicinity of the other channels can be further reduced.

The pressure chambers other than the pressure chamber located at the end may be respectively configured to cross connecting passages connected to their adjacent pressure chambers as viewed from above, and the pressure chamber located at the end is configured to cross the dummy connecting passage as viewed from above. In such a configuration, since the longitudinal direction of the pressure chamber is further reduced, high-density channels can be provided. In addition, as described above, the difference in stiffness between the regions in the vicinity of the pressure chambers is reduced, and uniform liquid droplet ejecting characteristic can be achieved.

The dummy connecting passage may have a shape substantially identical to a shape of the connecting passages. In such a configuration, since the regions in the vicinity of the channels have substantially the same structure, the difference in stiffness between the regions in the vicinity of the channels is further reduced.

The liquid droplet ejecting device may further comprise a dummy pressure chamber which is provided adjacent the pressure chamber located at the end in the direction in which the pressure chambers are arranged, the dummy pressure chamber forming an inner space corresponding to the dummy connecting passage. In such a configuration, since the region in the vicinity of the channel located at the end has substantially the same structure as the regions in the vicinity of the other channels, the difference in stiffness between the regions in the vicinity of the channels can be further reduced.

The connecting passages may have highest flow resistance in passages including the pressure chambers and the common ink chamber. In such a configuration, the region having such relatively high flow resistance is capable of effectively preventing the back flow of a fluid such as ink when the pressure chambers are pressurized.

The liquid droplet ejecting device may further comprise a pressure chamber plate provided with the pressure chambers; a common ink chamber plate provided with the common ink chamber; and a connecting passage plate interposed between the pressure chamber plate and the common ink chamber plate, the connecting passage plate, the common ink chamber plate, and the pressure chamber plate being stacked to form the connecting passages, the connecting passages extending along a surface of the common ink chamber plate. Thus, in the passage unit including the plates which are stacked to form the pressure chambers, the common ink chamber, and the connecting passages, high-density channels can be provided and uniform liquid droplet ejecting characteristic can be achieved in the channels.

At least one ends of the connecting passages may be connected to the pressure chambers or to the common ink chamber through holes formed on a plate interposed between the connecting passage plate and the pressure chamber plate or the common ink chamber plate.

The above and further objects and features of the invention will more fully be apparent from the following detailed description with accompanying drawings.

DETAILED DESCRIPTION OF THE PREFERRED EMBODIMENTS

Hereinafter, a liquid droplet ejecting device according to an embodiment of the present invention will be described with reference to the drawings. By way of example, an ink-jet printer head will be described with reference to the drawings.

Figure 1:
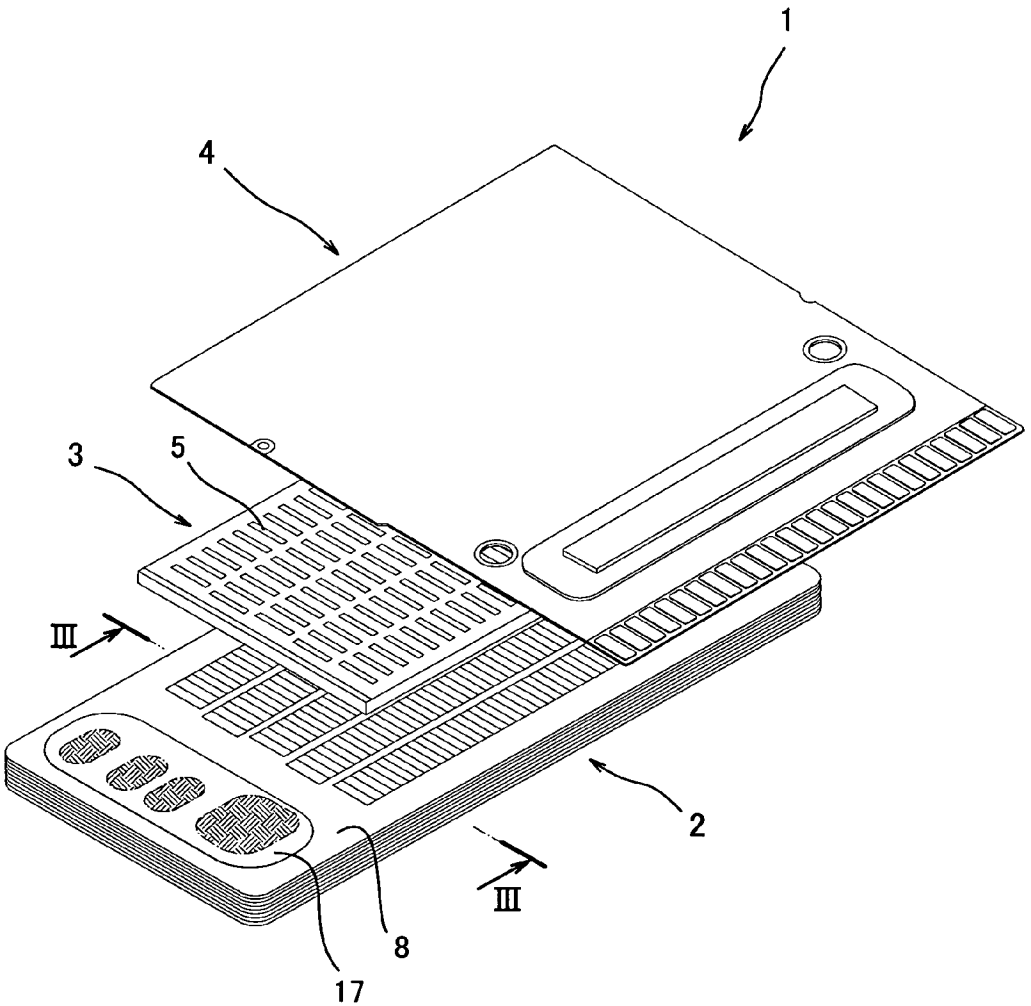
FIG. 1 is an exploded perspective view showing a structure of an ink-jet printer head.

FIG. 1 is an exploded perspective view showing a structure of an ink-jet printer head 1. As shown in FIG. 1, the ink-jet printer head 1 includes a passage unit 2 including a plurality of stacked plates, a piezoelectric actuator 3 which is overlaid on and is bonded to the passage unit 2, and a flexible flat cable 4 overlaid on the actuator 3 to establish electric connection to an external device. A plurality of surface electrodes 5 are provided on an upper surface of the actuator 3, and terminals (not shown) exposed on a lower surface of the flexible flat cable 4 are connected to the surface electrodes 5, enabling establishment of electric connection between them. As used herein, the directions are referenced such that the actuator 3 is disposed above the passage unit 2. Also, the other directions are suitably explained.

Figure 2:
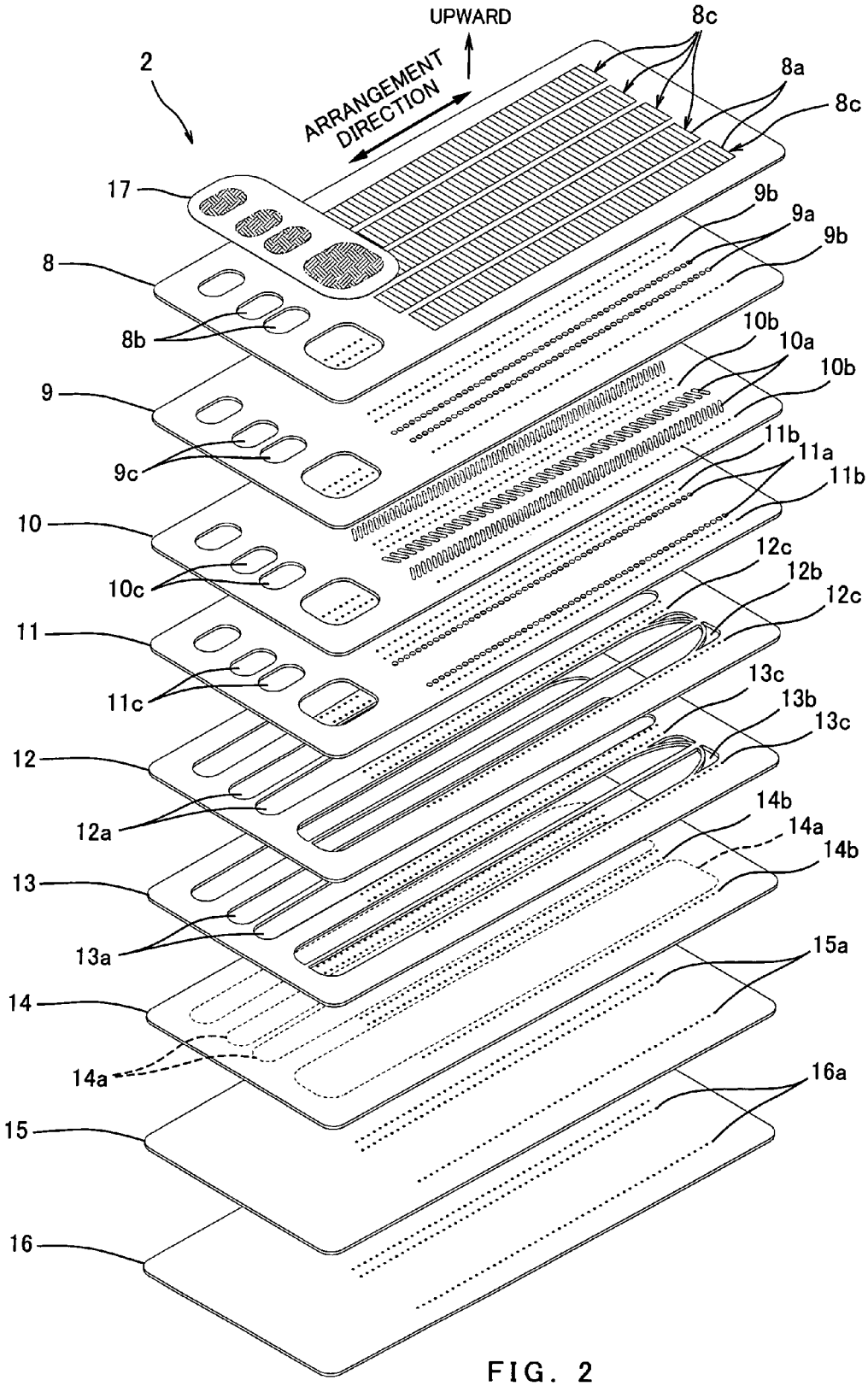
FIG. 2 is an exploded perspective view showing a structure of a passage unit of FIG. 1.
Figure 3:
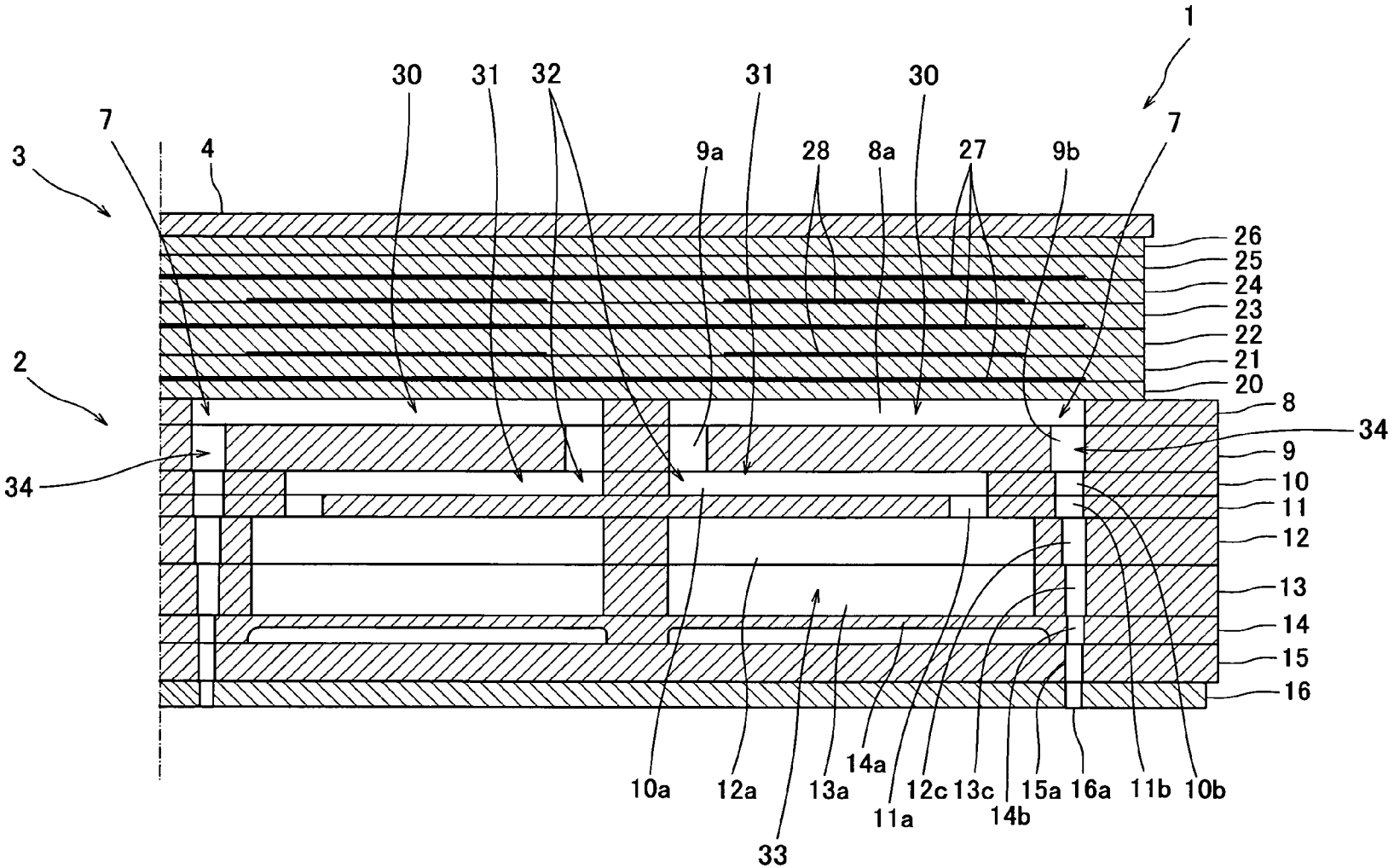
FIG. 3 is a cross-sectional view showing a part of a structure taken along lines III-III of FIG. 1, in which an actuator and a flexible flat cable are stacked on and bonded to the passage unit of FIG. 1.

FIG. 2 is an exploded perspective view showing a structure of the passage unit 2 shown in FIG. 1. FIG. 3 is a cross-sectional view taken along line III-III of FIG. 1, showing a part of a structure in which the actuator 3, and the flexible flat cable 4 are stacked on the passage unit 2 of FIG. 1. Turning now to FIGS. 2 and 3, the passage unit 2 includes a pressure chamber plate 8, a first spacer plate 9, a restricting plate 10, a second spacer plate 11, a first manifold plate 12, a second manifold plate 13, a damper plate 14, a cover plate 15, and a nozzle plate 16 which are arranged in this order from above and are stacked and bonded to each other. The nozzle plate 16 is a resin sheet made of, for example, polyimide. The plates 8 to 15 are metal plates such as 42% nickel alloy steel plates (42 alloy). The plates 8 to 16 are of a rectangular shape as viewed from above and each has a thickness of approximately 50 μm to 150 μm. The plates 8 to 15 are provided with holes or recesses forming passages constituting channels 7 by electrolytic etching, laser beam machining, plasma jet machining, or the like.

As shown in FIG. 2, the pressure chamber plate 8 has a number of pressure chamber holes 8*a* and ink supply holes 8*b*. The pressure chamber holes 8*a* are elongate holes extending in the direction of a short side of the pressure chamber plate 8 and are arranged in parallel along a long side of the pressure chamber plate 8. The pressure chamber holes 8*a* thus arranged form pressure chamber hole rows 8*c*. In the pressure chamber plate 8, five pressure chamber bole rows 8*c* are provided: two rows for black ink and one row for each of cyan ink, magenta ink, and yellow ink. By bonding the actuator 3 to the pressure chamber plate 8 from above and by bonding the first spacer plate 9 to the pressure chamber plate 8 from below, the pressure chamber holes 8*a* form the pressure chambers 30 having internal spaces (see FIG. 3). Four ink supply holes 8*b* are respectively provided for the black ink, the cyan ink, the magenta ink, and the yellow ink.

The first spacer plate 9 is provided with connecting holes 9*a* connected to one ends of the pressure chamber holes 8*a* of the pressure chamber plate 8, through holes 9*b* connected to opposite ends of the pressure chamber holes 8*a*, and ink supply holes 9*c* which have the same shape as that of the ink supply holes 8*b* and are respectively connected to the ink supply holes 8*b*.

The restricting plate 10 is provided with restricting holes 10*a* of an elongate hole shape. The connecting holes 9*a* of the first spacer plate 9 are connected to one ends of the restricting holes 10*a*. The restricting plate 10 is further provided with through holes 10*b* which are connected to the through holes 9*b* of the first spacer plate 9 and have the same shape as that of the through holes 9*b*, and ink supply holes 10*c* which are connected to the ink supply holes 9*c* of the first spacer plate 9 and have the same shape as that of the ink supply holes 9*c*. The restricting holes 10*a* form restricting portion 31 (see FIG. 3) with the restricting plate 10, the first spacer plate 9, and the second spacer plate 11 stacked and bonded to each other such that the restricting plate 10 is interposed between the first spacer plate 9 and the second spacer plate 11.

The second spacer plate 11 is provided with connecting holes 11*a* which are connected to opposite ends of the restricting holes 10*a* of the restricting plate 10 and through holes 11*b* which are connected to the through holes 10*b* of the restricting plate 10 and have the same shape as that of the through holes 10*b*. The connecting holes 9*a* of the first spacer plate 9, the restricting holes 10*a* of the restricting plate 10, and the connecting holes 11*a* of the second spacer plate 11 form restricting passage 32 (see FIG. 3) through which the pressure chambers 30 and the common ink chamber 33 fluidically communicate with each other (see FIG. 3). The second spacer plate 11 is provided with ink supply holes 11*c* which are connected to the ink supply holes 10*c* of the restricting plate 10 and have the same shape as that of the ink supply holes 10*c*.

The first manifold plate 12 has manifold holes 12*a* below and in correspondence with the pressure chamber holes 8*a* so as to extend along the pressure chamber hole rows 8*c*. Five rows of manifold holes 12*a* are provided: two rows for the black ink and one row for each of the cyan ink, the magenta ink, and the yellow ink. The manifold holes 12*a* are connected to the pressure chambers 30 via the restricting passages 32 and at one ends thereof to the ink supply holes 11*c* of the second spacer plate 11. In this embodiment, the opposite ends of the two rows of manifold holes 12*a* for the black ink have a pointed shape, and openings 12*b* are formed in the vicinity of the opposite ends of these manifold holes 12*a*. The first manifold plate 12 is provided with a number of through holes 12*c* which are connected to the through holes 11*b* of the second spacer plate 11 so as to be arranged along the longitudinal direction of the manifold holes 12*a* and have the same shape as that of the through holes 11*b*.

The second manifold plate 13 has the same shape as that of the first manifold plate 12 and has five manifold holes 13*a*, openings 13*b* and through holes 13*c*. With the second spacer plate 11, the first manifold plate 12, the second manifold plate 13, and the damper plate 14 stacked and bonded to each other, the manifold holes 12*a* and 13*a* form five common ink chambers 33 (see FIG. 3). Among the five common ink chambers 33, adjacent two common ink chambers 33 are intended for the black ink and the remaining three common ink chambers 33 are respectively intended for the cyan ink, the magenta ink, and the yellow ink.

The damper plate 14 has five damper walls 14*a* recessed from below to be thinned at regions respectively correspond to the common ink chambers 33. The damper plate 14 is provided with through holes 14*b* which are arranged along the longitudinal direction of the damper walls 14*a*, are connected to the through holes 13*c* of the second manifold plate 13 and have the same shape as that of the through holes 13*c*.

The cover plate 15 is provided with through holes 15*a* which are connected to the through holes 14*b* of the damper plate 14 and have the same shape as that of the through holes 14*b*. The nozzle plate 16 is provided with nozzle holes 16*a* connected to the through holes 15*a* of the cover plate 15.

By stacking the plates 8 to 16 and bonding them to each other, the passage unit 2 shown in FIG. 3 is formed. In the interior of the passage unit 2, the ink supply holes 8*b*, 9*c*, 10*c*, and 11*c* formed on the plates 8 to 11 are connected to each other, thereby forming ink supply passages (not shown). The ink supply passages are connected to one ends of the common ink chambers 33. Through the ink supply passages, the ink supplied from an external ink tank (not shown) to the common ink chambers 33 flows. As described above, the connecting holes 9*a*, the restricting holes 10*a*, and the connecting holes 11*a* formed on the plates 9 to 11 are connected to each other to form the restricting passages 32 through which the common ink chamber 33 and the pressure chambers 30 fluidically communicate with each other. Furthermore, the through holes 9*b*, 10*b*, 11*b*, 12*c*, 13*c*, 14*b*, and 15*a* formed on the plates 9 to 15 are connected to each other to form discharge passages 34 which are connected to the nozzle holes 16*a*. In the passage unit 2, a filter 17 is provided over the ink supply holes 8*b* of the pressure chamber plate 8 to remove dust from the ink supplied from the external ink tank.

As shown in FIG. 3, the actuator 3 includes a stacked structure of a number of piezoelectric sheets 20 to 25 and an insulating top sheet 26. The piezoelectric sheets 20 to 25 are each formed of ceramic material of lead zirconate titanate (PZT) and each has a thickness of approximately 30 μm. Common electrodes 27 are printed on the upper surfaces of the piezoelectric sheet 20 as a lowermost layer, the piezoelectric sheet 22, and the piezoelectric sheet 24 which are first, third and fifth sheets from below and are disposed to correspond to the pressure chambers 30 (see FIG. 2) formed by the pressure chamber plate 8 of the passage unit 2. Five rows of a number of separate electrodes 28 are disposed on the upper surfaces of the piezoelectric sheets 21 and 23 which are second and fourth sheets from below to respectively correspond to the pressure chambers 30, although two rows of separate electrodes 28 are illustrated in FIG. 3. The common electrodes 27 and the separate electrodes 28 are electrically connected to the surface electrodes 5 (see FIG. 1) formed on the upper surface of the top sheet 26 which is an uppermost layer, via relay wires (not shown) provided on side end surfaces of the piezoelectric sheets 20 to 25 and the top sheet 26 or provided in the through holes (not shown).

The ink-jet printer head 1 structured above operates as follows to eject the ink (liquid droplet) from the nozzle holes 16*a*. First, the ink is supplied from the external ink tank (not shown) via the filter 17 and is filled in the channels 7 including the ink supply passages, the common ink chambers 33, the restricting passages 32, the pressure chambers 30 and the discharge passages 34. In this state, when a voltage is selectively applied to a plurality of separate electrodes 28 of the actuator 3, a potential difference is generated between the separate electrodes 28 applied with the voltage and the corresponding common electrodes 27, and an electric field acts on activated portions of the piezoelectric sheets 21 to 24, causing deformation in the direction in which the sheets 21 to 24 are stacked. As used herein, the term "activated portions" refer to regions sandwiched between the separate electrodes 28 and the common electrodes 27 in the piezoelectric sheets 21 to 24, and regions where substantially the deformation occurs.

When the activated portions are deformed as described above, the piezoelectric sheet 20 which is the lowermost layer protrudes into the pressure chambers 30, and thereby an internal pressure of the pressure chambers 30 increases, causing the ink to be ejected from the nozzle holes 16*a* to outside through the discharge passages 34. A pressure wave generated by the increase in the internal pressure of the pressure chambers 30 propagates toward upstream side, i.e., the restricting passages 32. Since the restricting passages 32 have cross-sectional areas smaller than those of the pressure chambers 30 and the like as shown in FIG. 3, a flow resistance of the ink in the channels 7 is higher in the restricting passages 32 than in the other passages. For this reason, a large part of the pressure wave propagating from the pressure chambers 30 toward the upstream side is cut off in the restricting passages 32. The remaining pressure wave reaching the common ink chambers 33 through the restricting passages 32 is absorbed by elastic deformation of the thin damper walls 14*a*.

EXAMPLE 1

Figure 4:
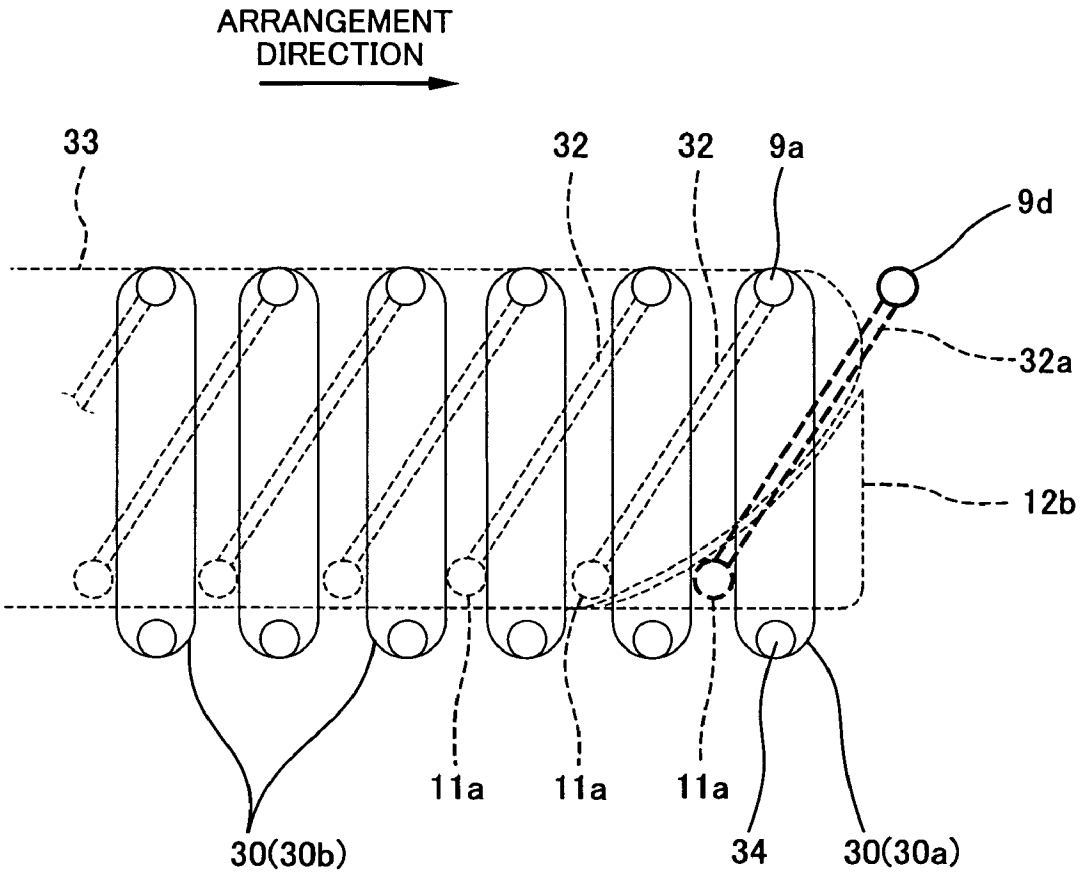
FIG. 4 is a schematic view showing a structure of a common ink chamber, pressure chambers, and restricting passages connecting the common ink chamber to the pressure chambers, as viewed from a direction in which the plates are stacked.
Figure 5:
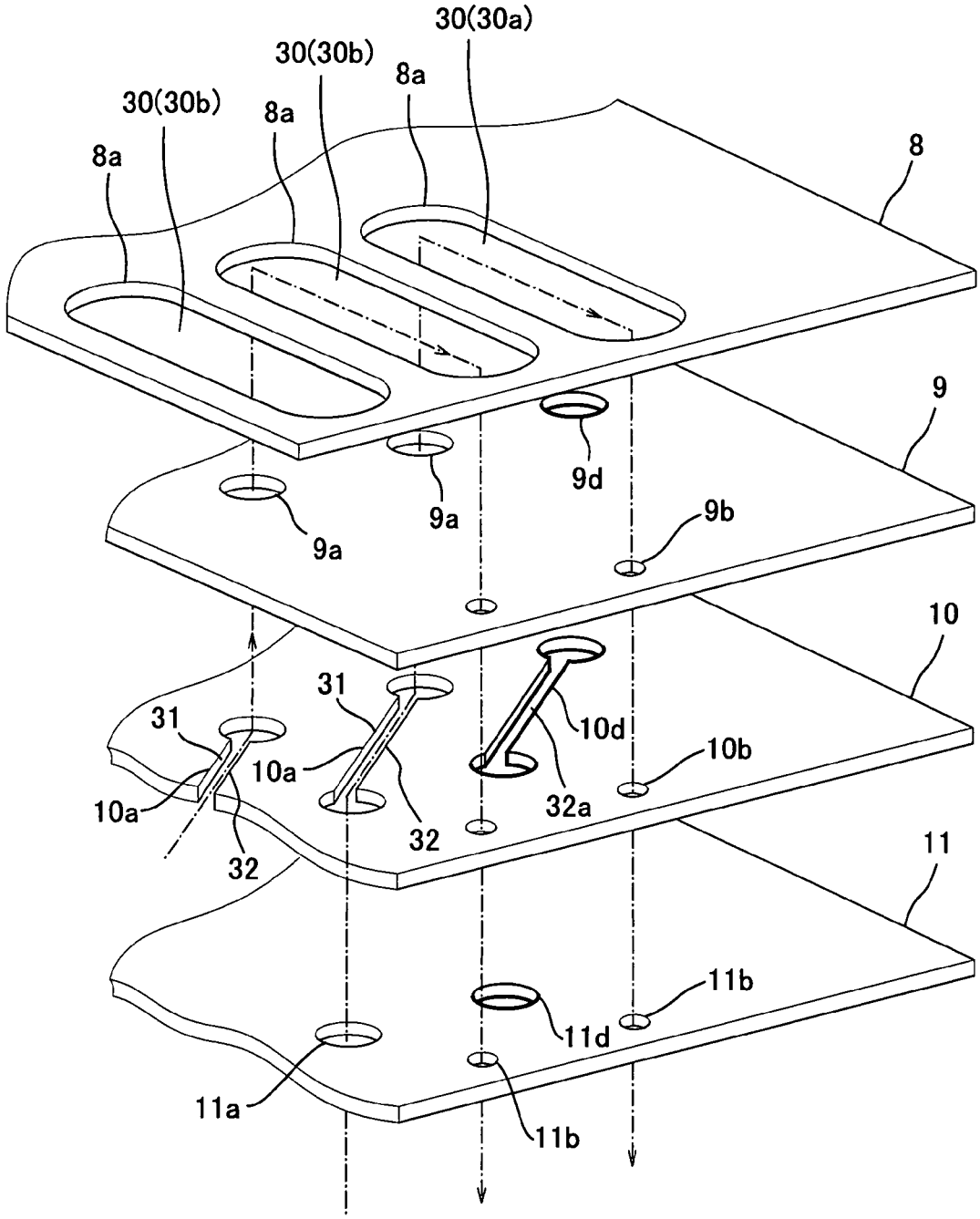
FIG. 5 is a partial perspective view of a pressure chamber plate, a first spacer plate, and a restricting plate, showing a positional relationship of pressure chamber holes forming pressure chambers, connecting holes forming a part of the restricting passages, and restricting holes forming restricting portions in the restricting passages.

Subsequently, a structure of a part of the channels 7 formed in the passage unit 2 of the ink-jet printer head 1 will be described with reference to FIGS. 4 and 5. FIG. 4 is a schematic view showing a structure of the common ink chamber 33, the pressure chambers 30 and the restricting passages 32 connecting the common ink chamber 33 to the pressure chambers 30, as viewed from the direction in which the plates are stacked. FIG. 5 is a partial perspective view of the pressure chamber plate 8, the first spacer plate 9, and the restricting plate 10, showing a positional relationship of the pressure chamber holes 8*a* forming the pressure chambers 30, the connecting holes 9*a* forming a part of the restricting passages 32, and the restricting holes 10*a* forming the restricting portions 31 in the restricting passages 32. In FIG. 5, for the purpose of easier understanding of the relation of the pressure chamber holes 8*a*, the connecting holes 9*a*, and the restricting holes 10*a*, flow of the ink is indicated by dashed line.

As shown in FIGS. 4 and 5, the passage unit 2 of the example 1 includes a plurality of pressure chambers 30 provided in parallel and a plurality of restricting passages 32 which are provided in parallel and are respectively connected to the plurality of pressure chambers 30. The restricting passages 32 are, as described above, connected to one ends of the pressure chambers 30 and extend from connected regions such that they are tilted with respect to the longitudinal direction of the pressure chambers 30.

A dummy restricting passage 32*a* is provided adjacent the restricting passage 32 located at an end in the direction in which the restricting passages 32 are arranged. That is, the restricting plate 10 is provided with a dummy restricting hole 10*d* located adjacent the restricting hole 10*a* located at an end in the direction in which the restricting holes 10*a* are arranged. The first spacer plate 9 sandwiched between the pressure chamber plate 8 and the restricting plate 10, is provided with a dummy connecting hole 9*d* connected to the dummy restricting hole 10*d*. The second spacer plate 11 is provided with a dummy connecting hole 11*d* connected to the dummy restricting hole 10*d*. The dummy restricting hole 10*d*, and the dummy connecting holes 9*d* and 11*d* form a dummy restricting passage 32*a*. In FIG. 4, the dummy restricting passage 32*a* is indicated by a line thicker than that indicating the restricting passage 32. Also, in FIG. 5, the dummy restricting hole 10*d* is indicated by a line thicker than that indicating the restricting holes 10*a*, and the dummy connecting holes 9*d* and 11*d* are indicated by lines thicker than those indicating the connecting holes 9*a* and 11*a*.

The dummy restricting passage 32*a* (dummy restricting hole 10*d* and dummy connecting holes 9*d* and 11*d*) have substantially the same shape as that of the restricting passages 32 (restricting hole 10*a* and connecting holes 9*a* and 11*a*). The dummy restricting passage 32*a* is positioned to be spaced apart from the restricting passage 32 located at the end with a distance substantially equal to that between the restricting passages 32. That is, the restricting passage 32 and the dummy restricting passage 32*a* are arranged in parallel to be equally spaced apart.

Although the dummy restricting hole 10*d* and the dummy connecting holes 9*d* and 11*d* are connected to each other to form the dummy restricting passage 32*a*, there exists no corresponding pressure chamber 30. Therefore, the dummy restricting hole 10*d* and the dummy connecting holes 9*d* and

11*d* do not form the channel 7. As shown in FIG. 4, the pressure chambers 30*b* other than the pressure chamber 30*a* located at the end in the direction in which the pressure chambers 30 are arranged cross the restricting passages 32 connected to their adjacent pressure chambers 30 (pressure chambers 30 located adjacent the pressure chambers 30*b*) on one side as viewed from above, i.e., from the direction in which the plates are stacked. The pressure chamber 30*a* located at the end crosses the dummy restricting passage 32*a* as viewed from above.

Whereas the connecting holes 11*a* and the dummy connecting hole 11*d* are each positioned between the pressure chambers 30 as viewed from above, they may be positioned to overlap with their adjacent pressure chambers 30. It should be noted that the dummy connecting hole 11*d* may be formed not to penetrate the second spacer plate 11 completely.

In the passage unit 2 structured above, since the restricting passages 32 are provided to be tilted with respect to the longitudinal direction of the pressure chambers 30, the length of the restricting passages 32 can be set substantially equal to or larger than the width of the common ink chamber 33 and the longitudinal length of the pressure chamber 30. Thus, the length of the pressure chambers 30 can be reduced. This makes it possible to increase the number of pressure chamber holes 8*a* to be formed on the pressure chamber plate 8. As a result, high-density channels 7 is achieved.

Since the restricting passages 32 and the dummy restricting passage 32*a* are provided to cross all the pressure chambers 30 (30*a* and 30*b*), the regions in the vicinity of the pressure chambers 30 have substantially the same structure, and thus uniform stiffness is obtained in the regions in the vicinity of the pressure chambers 30. As a result, a uniform ink ejecting characteristic is achieved in the channels 7 including the pressure chambers 30.

Whereas the dummy restricting passage 32*a* is formed by the dummy restricting hole 10*d* and the dummy connecting hole 9*d* in the example 1, it may alternatively be formed only by the dummy restricting hole 10*d*.

EXAMPLE 2

Figure 6:
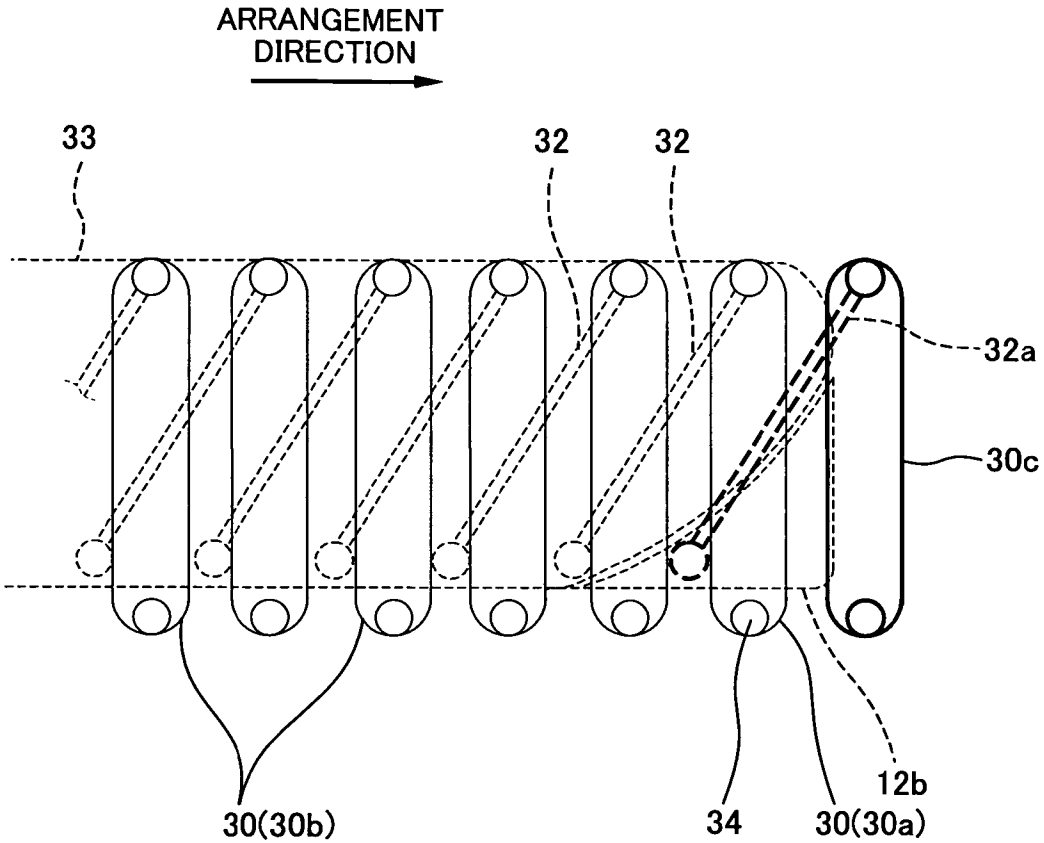
FIG. 6 is a schematic view showing another structure of the common ink chamber, the pressure chambers, and the restricting passages connecting the common ink chamber to the pressure chambers.

FIG. 6 is a schematic view showing another structure of the common ink chamber 33, the pressure chambers 30 and the restricting passages 32 connecting the common ink chamber 33 to the pressure chambers 30. Since the structure shown in FIG. 6 is in large part identical to that of FIG. 4, a distinction between the structure of FIG. 6 and the structure of FIG. 4 will be described.

As shown in FIG. 6, in the passage unit 2, a dummy pressure chamber 30*c* is provided adjacent the pressure chamber 30*a* located at an end in the direction in which the plurality of pressure chambers 30 are arranged. The dummy pressure chamber 30*c* forms a closed internal space to correspond to the dummy restricting passage 32*a*. In FIG. 6, the dummy restricting passage 32*a* and the dummy pressure chamber 30*c* are indicated by lines thicker than those indicating the restricting passages 32 and the pressure chambers 30.

In the passage unit 2 structured above, since a region in the vicinity of the pressure chamber 30*a* located at the end has substantially the same structure as the regions in the vicinity of the other pressure chambers 30*b*, stiffness of the passage unit 2 in the regions in the vicinity of the pressure chambers 30 (30*a*, 30*b*) is made uniform. As a result, a more uniform ink ejecting characteristic can be achieved.

EXAMPLE 3

Figure 7:
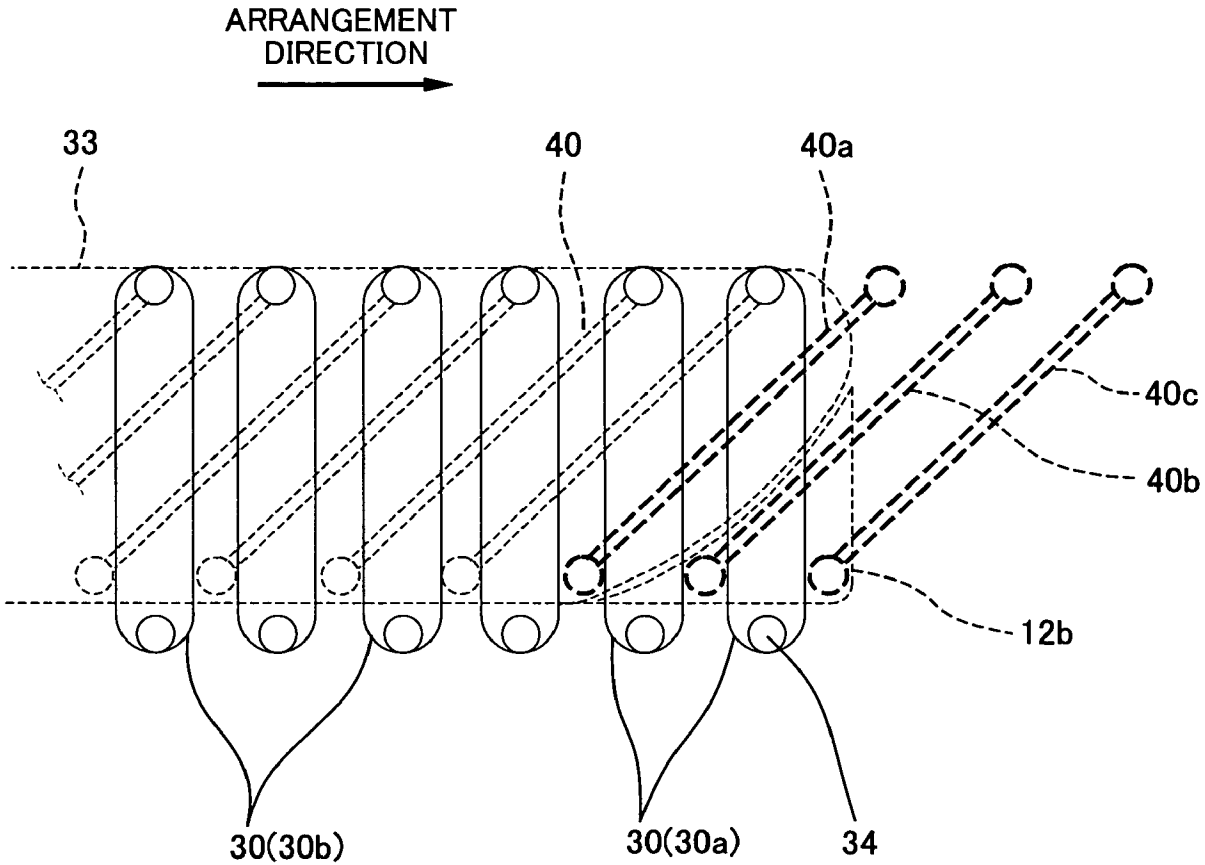
FIG. 7 is a schematic view showing still another structure of the common ink chamber, the pressure chambers, and the restricting passages connecting the common ink chamber to the pressure chambers.

FIG. 7 is a schematic view showing another structure of the common ink chamber 33, the pressure chambers 30, and restricting passages 40 connecting the common ink chamber 33 to the pressure chambers 30. Since the structure shown in FIG. 7 is in large part identical to that of FIG. 4, a distinction between the structure of FIG. 7 and the structure of FIG. 4 will be described.

As shown in FIG. 7, the passage unit 2 of the example 3 is provided with a plurality of restricting passages 40 which are arranged in parallel and are respectively connected to the plurality of pressure chambers 30. As in the structure shown in FIG. 4, the restricting passages 40 are respectively connected to one ends of the pressure chambers 30. But, the restricting passages 40 are tilted with respect to the pressure chambers 30 with an angle larger than that of the restricting passages 32 of FIG. 4. The plurality of restricting passages 32 cross each pressure chamber 32 as viewed from above.

A plurality of (three in this embodiment) dummy restricting passages 40*a* to 40*c* are provided adjacent the restricting passage 40 located at the end in the direction in which the restricting passages 40 are arranged. In FIG. 7, the dummy restricting passages 40*a* to 40*c* are indicated by lines thicker than those indicating the restricting passages 40. As in the restricting passage 32*a* of FIG. 4, the dummy restricting passages 40*a* to 40*c* have substantially the same shape as that of the restricting passages 40 and are positioned to be spaced apart from the restricting passage 40 located at the end with a distance substantially equal to that between the restricting passages 40. That is, the restricting passage 40 and the dummy restricting passages 40*a* to 40*c* are arranged in parallel to be equally spaced apart.

The dummy restricting passages 40*a* to 40*c* form closed spaces in the interior of the passage unit 2. Since there exist no pressure chambers 30, common ink chambers 33, and others corresponding to the dummy restricting passages 40*a* to 40*c*, the dummy restricting passages 40*a* to 40*c* do not form the channels 7. As shown in FIG. 7, the pressure chambers 30*b* other than a first pressure chamber 30*a* located at an end and a second pressure chamber 30*a* adjacent the first pressure chamber 30*a*, cross the two restricting passages 40 connected to their adjacent two pressure chambers 30 (two pressure chambers 30 adjacent the pressure chambers 30*b*) on one side as viewed from above, i.e., as viewed from the direction in which the plates are stacked. The first pressure chamber 30*a* crosses the two dummy restricting passages 40*a* and 40*b* as viewed from above, and the second pressure chamber 30*a* crosses one restricting passage 40 and one dummy restricting passage 40*a* as viewed from above. In contrast, the dummy restricting passage 40*c* is provided not to cross any pressure chamber 30.

In the passage unit 2 structured as described above, the restricting passages 40 are tilted with a large angle with respect to the longitudinal direction of the pressure chambers 30, the presence of the restricting passages 40 do not make it difficult to reduce the length of the pressure chambers 30. So, the length of the pressure chambers 30 can be further reduced. Therefore, more pressure chamber holes 8*a* (see FIG. 2) can be formed on the pressure chamber plate 8. As a result, higher density channels 7 can be provided.

Since the restricting passages 40 and the dummy restricting passages 40*a* and 40*b* are provided to cross all the pressure chambers 30 (30*a*, 30*b*), uniform stiffness of the passage unit 2 is achieved in the regions in the vicinity of the pressure chambers 30. In addition, the dummy restricting passage 40*c* is provided laterally of the pressure chamber 30*a* located at the end not to cross the pressure chamber 30*a* as viewed from above. Since the region in the vicinity of the pressure chamber 30*a* located at the end has substantially the same structure as the regions in the vicinity of the other pressure chambers 30, stiffness of the passage unit 2 is made uniform in the regions in the vicinity of the pressure chambers 30. As a result, a more uniform ink ejecting characteristic can be achieved.

The common ink chambers 33 have tapered end portions which are distant from the ink supply passages 8*b*, 9*c*, 10*c*, and 11*c* to prevent stagnation of the ink and bubbles contained in the ink. Outside the tapered portions, the openings 12*b* and 13*b* are formed. In such a configuration, difference in stiffness between the regions in the vicinity of the openings 12*b* and 13*b* and the regions in the vicinity of the common chambers 33 in the manifold plates 12 and 13 becomes small. The openings 12 and 13 cooperate with the restricting passages to achieve more uniform ink ejecting characteristic in the respective pressure chambers 30.

Whereas in the above described examples, the restricting holes 10*a* are formed on the restricting plate 10 rather than the first and second spacer plates 9 and 11, the restricting plate 10 may be omitted, and the restricting holes 10*a* may be formed like grooves on the lower surface of the first spacer plate 9 or on the upper surface of the second spacer plate 11.

Instead of the piezoelectric actuator 3, a variety of driving sources, for example, a driving source for driving a oscillation plate by static electricity to apply a pressure to the pressure chambers 30, may be used.

While the liquid droplet ejecting device of the present invention is applied to the ink-jet printer, it may be applied to, for example, devices for applying liquid in thin film shape.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A liquid droplet ejecting device comprising:

a plurality of pressure chambers arranged in parallel to feed ink inside thereof toward nozzles by pressure fluctuation;

a plurality of connecting passages which are arranged in parallel and are respectively connected to the plurality of pressure chambers to guide ink from a common ink chamber to the plurality of pressure chambers; and a dummy connecting passage provided to be located adjacent a connecting passage located at an end in a direction in which the connecting passages are arranged;

wherein pressure chambers other than a pressure chamber located at an end in which the pressure chambers are arranged are respectively configured to at least partially overlap with connecting passages connected to their adjacent pressure chambers as viewed from above; and wherein the dummy connecting passage forms an inner space at least partially overlapping with the pressure chamber located at the end as viewed from above.

2. The liquid droplet ejecting device according to claim 1, wherein the dummy connecting passage is positioned to be spaced apart from the connecting passage located at the end with a distance substantially equal to a distance between the arranged connecting passages.

3. The liquid droplet ejecting device according to claim 1, wherein the dummy connecting passage includes a plurality of dummy connecting passages arranged adjacent the connecting passage located at the end and along the direction in which the connecting passages are arranged.

4. The liquid droplet ejecting device according to claim 3, wherein the pressure chambers other than the pressure chamber located at the end are respectively configured to cross the connecting passages connected to their adjacent pressure chambers as viewed from above, and the pressure chamber located at the end is configured to cross the dummy connecting passage as viewed from above.

5. The liquid droplet ejecting device according to claim 1, wherein the dummy connecting passage has a shape substantially identical to a shape of the connecting passages.

6. The liquid droplet ejecting device according to claim 1, further comprising:

a dummy pressure chamber which is provided adjacent the pressure chamber located at the end in the direction in which the pressure chambers are arranged, the dummy pressure chamber forming an inner space corresponding to the dummy connecting passage.

7. The liquid droplet ejecting device according to claim 1, wherein the connecting passages have highest flow resistance in passages including the pressure chambers and the common ink chamber.

8. The liquid droplet ejecting device according to claim 1, further comprising:

a pressure chamber plate provided with the pressure chambers;

a common ink chamber plate provided with the common ink chamber; and a connecting passage plate interposed between the pressure chamber plate and the common ink chamber plate, the connecting passage plate, the common ink chamber plate, and the pressure chamber plate being stacked to form the connecting passages, the connecting passages extending along a surface of the common ink chamber plate.

9. The liquid droplet ejecting device according to claim 8, wherein at least one ends of the connecting passages are connected to the pressure chambers or to the common ink chamber through holes formed on a plate interposed between the connecting passage plate and the pressure chamber plate or the common ink chamber plate.

* * * * *